United States Patent [19]

Burgess et al.

[11] 4,256,425

[45] Mar. 17, 1981

[54] LATCH ASSEMBLY FOR DUNNAGE BARS

[75] Inventors: Leonard G. Burgess, New Baltimore; Richard E. Wroblewski, Roseville, both of Mich.

[73] Assignee: Equipment Manufacturing, Inc., Warren, Mich.

[21] Appl. No.: 19,864

[22] Filed: Mar. 12, 1979

[51] Int. Cl.[3] ..... B61D 45/00

[52] U.S. Cl. ..... 410/149; 410/150

[58] Field of Search ..... 410/149, 150

[56] References Cited

U.S. PATENT DOCUMENTS

| | | | |
|---|---|---|---|
| 2,354,861 | 8/1944 | Hermann | 410/150 |
| 2,425,875 | 8/1947 | Hermann | 410/150 |
| 2,769,404 | 11/1956 | Dietrichson | 410/149 |
| 3,114,335 | 12/1963 | Shroeder et al. | 410/149 |

*Primary Examiner*—Richard A. Bertsch

*Attorney, Agent, or Firm*—Joseph W. Farley

[57] ABSTRACT

A latch assembly for connecting a tubular dunnage bar to a support comprises a tubular housing received within an end of the bar, a connector member and a latch plate slidably mounted in the housing, and a single bellows-type spring which is confined in the housing and acts against the inner ends of both the connector member and the latch plate, extending their outer ends from the housing. Extending movement of the connector member is limited by a slot in the housing engaged by a pin on the connector member; movement of the latch plate is limited by a recess in the connector member engaged by a pin formed by part of an operating handle on the latch plate. The outer end of the connector is formed with a laterally projecting locking lug and, with the latch plate retracted, is adapted to be inserted through an opening in a surface of the support and moved laterally, placing the locking lug in overlapping engagement with the inner face of the surface. Subsequent spring urged movement of the latch plate into the opening prevents lateral movement of the connector member and disengagement of the locking lug.

10 Claims, 4 Drawing Figures

LATCH ASSEMBLY FOR DUNNAGE BARS

This invention relates to an improved latch assembly for use in connecting a dunnage bar between spaced supports forming part of the structure of a shipping rack or container.

More particularly, the present invention is directed to improvements in a dunnage bar latch assembly of the type having a connector member provided with a locking lug that can be placed in overlapping engagement with a surface of a support and is retained in such engagement by a latch which is engageable with an oppositely disposed surface of the support. Prior examples of latch assemblies of this general type are found in U.S. Pat. Nos. 2,769,404, 2,425,875, 2,354,861 and 3,114,335. These improvements of the invention increase the utility and ease of operability of the latch assembly while greatly simplifying its construction.

A latch assembly of the invention comprises a tubular housing adapted to be secured to a dunnage bar with an open end of the housing located adjacent to an end of the dunnage bar. A connector member and a latch plate, substantially coextensive in length, are slidably mounted in the housing with their outer ends extending therefrom, the connector member having a laterally projecting locking lug on its outer end and opposite to the lug having a surface which is slidably engaged by the latch plate, the arrangement being such that the connector member and the latch plate are slidably supported by the housing and by each other. A handle connected to the latch plate projects through an elongated slot in the wall of the housing, thereby defining the extent of relative movement between the latch plate and the housing; and preferably, the handle includes a portion which projects through the latch plate and into a recess in the connector member, thereby also providing a means for defining the extent of relative movement between the latch plate and the connector member. The inner ends of the connector member and the latch plate are engaged by a spring which is positioned in the housing and normally urges the connector member and the latch plate to positions in which their outer ends extend from the open end of the housing. These positions are defined by means for limiting sliding movement of the connector member in the housing and by the aforementioned slot or recess engaged by the handle on the latch plate.

Preferably, the dunnage bar is a tubular member within which the latch assembly housing is mounted with the outer end of the housing at one end of the tubular dunnage bar member.

Other features and advantages of the invention will appear from the description to follow of the presently preferred embodiment illustrated in the accompanying drawings.

DESCRIPTION OF THE PREFERRED EMBODIMENT

Figure 4:
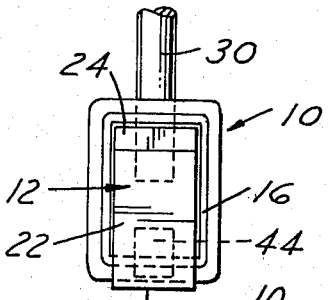

For simplicity, the structure disclosed in the drawings has been confined to one end of a dunnage bar 10, of rectangular tubular construction as shown in FIG. 4, and to one latch assembly 12 of the invention used for connecting the end of the dunnage bar 10 to a support 14, such as an upright member of a shipping rack. Those skilled in the art appreciate that such a dunnage bar 10 would ordinarily be connected between a spaced pair of supports 14; and that a second latch assembly 12 would be employed at the other end of the dunnage bar 10 for this purpose. This second latch assembly would be constructed in the manner described below.

The latch assembly 12 includes a tubular housing 16, having an open end 17 and an opposite end closed by a plate 18, adapted to be placed within and secured to the dunnage bar 10 with the open end 17 of the housing 16 adjacent to the end 20 of the dunnage bar. A connector member 22 and a latch plate 24, which are substantially coextensive in length as shown in FIG. 1, are slidably mounted in the housing with their respective outer ends 23 and 25 extending therefrom, and the outer end 23 of the connector member 22 is provided with a laterally projecting locking lug 26.

Figure 1:
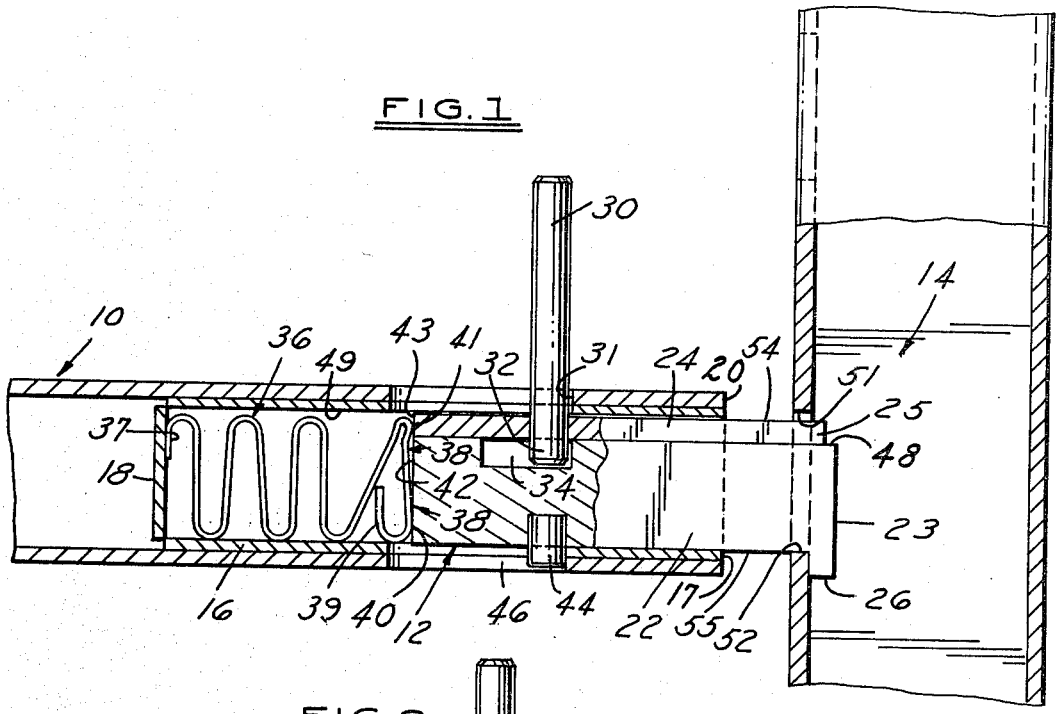
FIG. 1 is a side elevation partly in section, showing one end of a horizontal dunnage bar connected by a latch assembly of the invention to a vertical support.

As shown in FIGS. 1 and 4, the combined cross-sectional area of the portions of the connector member 22 and the latch plate slidably mounted in the housing is but slightly less than the inner cross-sectional area of the housing. A flat surface 28 on the connector member 22, which surface faces oppositely from the locking lug 26, is slidably engaged by the latch plate 24. Consequently, the connector member 22 and the latch plate 24 are slidably supported and guided by the housing 16 and by each other.

A handle 30 connected to the latch plate 24 projects through slots 31 in the walls of the housing 16 and the dunnage bar 10; and the handle 30 includes a portion 32 which extends through the latch plate 24 and into a recess 34 formed in the connector member 22, thereby providing an abutment means for permitting limited relative movement between the latch plate and the connector member. Positioned in the housing 16 is a bellows-type spring 36 having one end 37 fixed by the plate 18 at the closed end of the housing and having an opposite end 38 formed to simulanteously engage the inner ends 42 and 43 of the connector member 22 and the latch plate 24. A smooth acting simultaneous engagement is obtained by closing the opposite end 38 of the spring with a flexible reverse loop 39 having a curved surface 40 engaging the end 42 of the connector member 22, and by constricting the opposite loop 41 engaged by the end 43 of the latch plate 24 to a relatively less flexible condition than the loop 39. These loops 39 and 41 provide a non-binding simultaneous engagement and a non-uniform compressibility of the spring 36 to compensate for the various relative positions of the connector member 22 and the latch plate 24 shown in FIGS. 1-3.

The spring 36 normally urges the connector member 22 and the latch plate 24 to the positions shown in FIG. 1 in which their outer ends are extended relative to the open end 17 of the housing. This extended position of the connector member 22 is defined by motion limiting means comprising a pin 44 carried thereby and the outer end of elongated slots or apertures 46 in the walls of the housing 16 and the dunnage bar 10; and, the extended positions of the latch plate 24 is defined by engagement of either the handle 30 with the outer ends of the slots 31 or the handle portion 32 with the outer end of the recess 34. It can be seen from FIG. 1 that in these extended positions, the outer end 25 of the latch plate 24 extends from the housing 16 a distance less than does the outer end 23 of the connector member 22, forming a ledge 48.

The pin 44 can be permanently fastened to the connector member 22 so as to project into the slots 46 a distance less than the clearance between the connector member surface 28 and the housing wall 49 which it faces. Having mounted the housing 16 within the dunnage bar 10, assembly of the parts can then be accomplished by positioning the spring 36 in the housing 16, inserting the connector member 22 with attached pin 44 into the housing and compressing the spring until the pin 44 enters the slots 46, inserting the latch plate 24 (with the handle 30 detached) into the housing, and finally connecting the handle 30 to the latch plate with the handle portion 32 engaging the recess 34.

The support 14 is formed with apertures 50 at desired locations for connecting an end of the dunnage bar thereto. Each aperture 50 has a rectangular configuration of slightly greater area than the outer end 23 of the connector member 22 and provides a pair of opposed spaced portions 51 and 52 of the support between which the outer end of the connector member 22 is positionable with the locking lug 26 overlappingly engaging the portion 52. Retracting movement of the latch plate 24 is required in order to place the connector member in engagement with the support and is obtained either by manually moving the latch plate by the handle to the position shown in FIG. 2, or by placing the ledge 48 in engagement with the aperture portion 51 so that the outer end 25 of the latch plate 24 abuts the support, and by moving the dunnage bar 10 toward the support and the laterally toward the portion 52 of the aperture. In either case, when the connector means 22 is engaged with the support 14, the latch plate is released, either manually or automatically, and moves into the position shown in FIG. 1 in which it is engageable with the support portion 51 to prevent disengagement of the locking lug 26.

Figure 2:
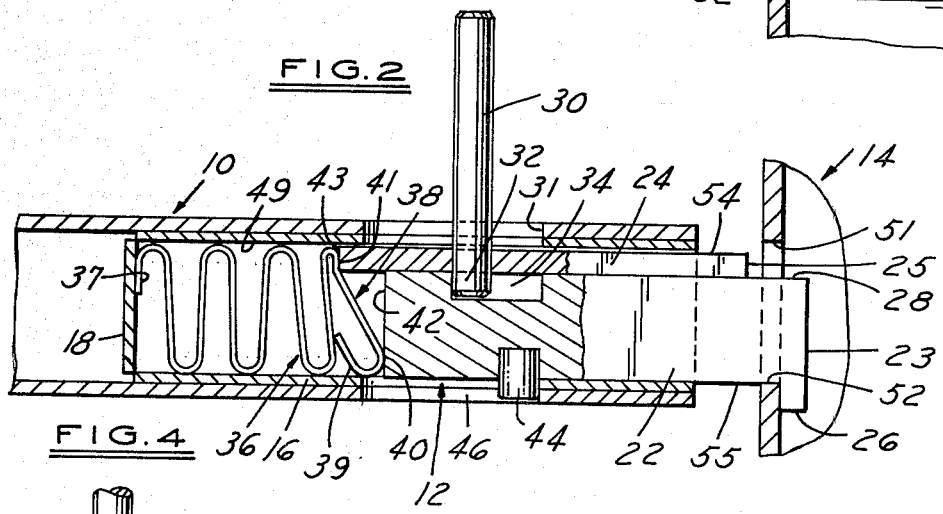
FIG. 2 is an elevation similar to FIG. 1 showing the latch assembly in unlatched position.
Figure 3:
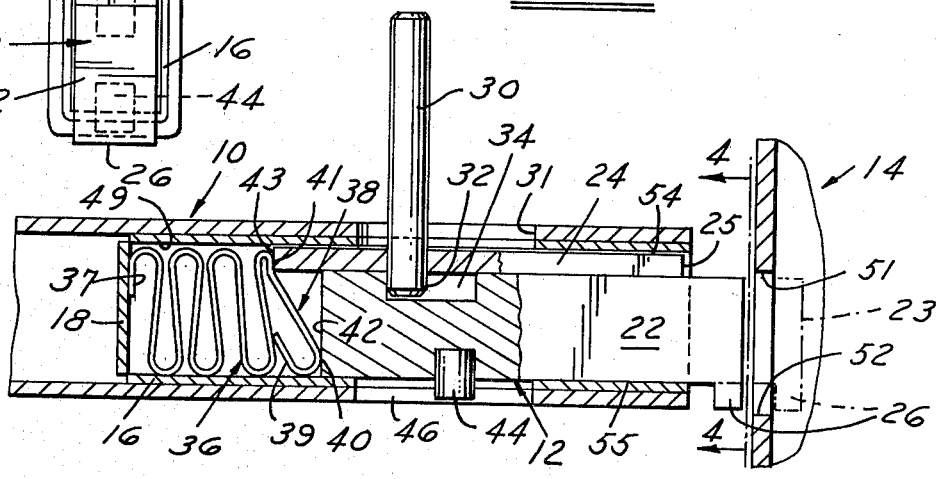
FIG. 3 is an elevation similar to FIG. 1 showing the latch assembly unlatched and disconnected from the support; and, FIG. 4 is an end elevation of the latch assembly and dunnage bar, taken as indicated by the line 4—4 of FIG. 3.

Disconnecting of the dunnage bar 10 from the support 14 is carried out by first manually retracting the latch plate 24 to the position shown in FIG. 2, by moving the dunnage bar 10 laterally to place the connector member 22 in the position shown in broken lines in FIG. 3, and by manually retracting the connector member to the position shown in full line in FIG. 3.

The operations of connecting and disconnecting a dunnage bar 10 equipped with the latch assembly 12 are made easier because the single spring 36 acts to urge both the connector member 22 and the latch plate 24 to normal extended positions from which they can be selectively retracted, as required, by operation of one handle 30. These normal extended positions are furthermore the locking positions of both the connector member and the latch plate, thus minimizing the possibility of an accidental disconnection of the dunnage bar 10 from the support 14. Other advantages of the latch assembly 12 are its simplicity of construction and that the oppositely facing surfaces 54 of the latch plate and 55 of the connector member are parallel and permit longitudinal movement of the dunnage bar 10 relative to the support 14 without a disconnection of the latch assembly from the support. Such longitudinal movement occurs because of swaying or weaving movements of supports during shipment and handling.

What is claimed is:

1. In a latch assembly for connecting an end of a dunnage bar to a support, the latch assembly including a connector member having an outer end provided with a laterally projecting locking lug, and a latch plate movable relative to the connector member, the outer end of the connector being positionable between a pair of opposed spaced portions of the support with the locking lug overlappingly engaging one of said portions and the latch plate being engageable with the other of said portions to prevent disengagement of the locking lug, the improvement wherein:

a tubular housing having an open end is adapted to be secured to the dunnage bar with the open end of the housing adjacent to an end of the dunnage bar;

the connector member and the latch plate are substantially coextensive in length and are slidably mounted in the housing with their outer ends extending therefrom, the connector member having a surface which is slidably engaged by the latch plate and which surface faces oppositely from the laterally projecting locking lug of the connector member, and a handle connected to the latch plate projects through a slot in the wall of the housing;

spring means positioned in the housing engages the inner ends of the connector member and the latch plate for normally urging their outer ends to extended positions relative to the open end of the housing;

motion limiting means acts between the connector member and the housing for limiting sliding movement of the connector member and defining the extended position thereof; and, abutment means acts between the connector member and the latch plate for permitting limited relative sliding movement therebetween.

2. A latch assembly according to claim 1, wherein the dunnage bar is a tubular member within which the latch assembly housing is mounted with the outer end of the housing adjacent to one end of the tubular dunnage bar member.

3. A latch assembly according to claim 1, wherein said abutment means comprises a recess formed in the connector member, and a projection carried by the latch plate and engaging said recess.

4. A latch assembly according to the claim 3, wherein said projection is formed by a portion of the handle which extends through the latch plate and into said recess.

5. A latch assembly according to claim 1 or 3, wherein said motion limiting means comprises a pin carried by the connector member and engaging an elongated aperture in the housing.

6. A latch assembly according to claim 5, wherein said elongated aperture and the slot through which the latch plate handle extends are substantially coextensive in length and are formed in opposite sides of the housing, said slot limiting relative movement between the latch plate and the housing.

7. A latch assembly according to claim 5, wherein the housing has a closed end opposite to said open end, and said spring means is a bellows-type spring having one end engaging the closed end of the housing and having an opposite end formed for simultaneous engagement with inner ends of the connector member and the latch plate.

8. A latch assembly according to claim 5, wherein in said extended positions of the connector member and the latch plate, the outer end of the latch plate extends from the housing a distance less than the outer end of the connector member.

9. A latch assembly according to claim 1, wherein said spring means is a bellows type spring having one end fixed and an opposite end formed for simultaneous engagement with the inner ends of the connector member and the latch plate.

10. A latch assembly according to claim 9, wherein said opposite end of the spring has a reverse loop engaging the inner end of the connector member and a constricted loop engaging the inner end of the latch plate, the constricted loop having less flexibility than the reverse loop.

* * * * *